United States Patent [19]

Matubara et al.

[11] 4,146,514

[45] Mar. 27, 1979

[54] PRESSURE-SENSITIVE ADHESIVE COMPOSITIONS

[75] Inventors: Saburo Matubara, Yokohama; Sakuya Iwai, Tokyo, both of Japan

[73] Assignee: Nippon Oil Company Ltd., Tokyo, Japan

[21] Appl. No.: 822,545

[22] Filed: Aug. 8, 1977

Related U.S. Application Data

[63] Continuation-in-part of Ser. No. 591,866, Jun. 30, 1975, abandoned.

[51] Int. Cl.[2] ..... C08L 25/10; C08L 25/16; C08L 15/00; C09J 3/14

[52] U.S. Cl. ..... 260/5; 260/4 AR; 260/888; 260/889; 260/890; 260/892; 260/893; 427/207 B; 526/290

[58] Field of Search ..... 260/4 AR, 892, 5; 526/290; 90/888, 889, 890

[56] References Cited

U.S. PATENT DOCUMENTS

| | | | |
|---|---|---|---|
| 3,554,940 | 1/1971 | Arakawa et al. | 260/5 |
| 3,652,725 | 3/1972 | Diaz et al. | 260/4 AR |
| 3,681,190 | 8/1972 | Dahlquist | 260/892 |
| 3,932,332 | 1/1976 | Douglas et al. | 260/892 |

*Primary Examiner*—John C. Bleutge

*Attorney, Agent, or Firm*—Hill, Gross, Simpson, Van Santen, Steadman, Chiara & Simpson

[57] ABSTRACT

The invention relates to a pressure-sensitive adhesive composition which comprises a rubber component including at least 50 percent by weight of styrene-butadiene copolymers in combination with a resin component consisting of an aromatic hydrocarbon resin resulting from the polymerization of a thermally cracked petroleum fraction at temperatures in the range of −30° to +60° C. in the presence of Friedel-Crafts catalysts. The fraction as recovered from petroleum refining has a boiling range of 140° to 220° C. but is further fractionated to separate components boiling above and below about 180° C. The material which is reacted has a conjugated diolefin content of 0.7 weight percent or less, and a ratio of conjugated diolefin content to total polymerizables of 3% or less. The total content of indene and its alkyl derivatives is 2 weight percent or less, and the ratio of indene content to total polymerizables is 8% or less. The fraction also contains significant amounts of vinyl toluenes boiling from 168° to 171° C.

4 Claims, No Drawings

PRESSURE-SENSITIVE ADHESIVE COMPOSITIONS

REFERENCE TO RELATED APPLICATION

This application is a continuation-in-part of our Ser. No. 591,866 filed June 30, 1975 now abandoned.

BACKGROUND OF THE INVENTION

1. Field of the Invention

This invention is in the field of pressure-sensitive adhesive compositions comprising a combination of synthetic and/or natural rubber in combination with a synthetic aromatic hydrocarbon resin resulting from the polymerization of a selected fraction of thermally cracked petroleum oil. The relative amounts of conjugated diolefins and indene and its derivatives are restricted to provide a highly satisfactory tackiness, adhesive and cohesive strength and other important properties.

2. Description of the Prior Art

Generally, pressure-sensitive adhesive compositions are considered satisfactory if they have a proper balance of tackiness, adhesive strength, cohesive strength, and weather resistance. Resinous materials which serve as adhesion and tack-imparting components must be highly compatible with rubbers and soluble in solvents.

Heretofore, pressure-sensitive adhesive compositions which have been used as adhesive coatings on tapes, sheets of paper, fabric and other backing materials have been proposed which are mixtures of natural rubber and/or synthetic rubber with a terpene resin. The resin is usually $\alpha$-pinene, $\beta$-pinene, or mixtures thereof which are present in refined pine resins. These naturally occurring substances are becoming more scarce and considerably more expensive.

Known pressure-sensitive adhesive compositions may contain rosin esters, aliphatic hydrocarbons, and cumarone-indene resins as tackifiers. These resins, however, are inferior to terpene resins with regard to their balance of cohesive strength, adhesive strength, tackiness and other important properties, and are further not very compatible with rubbers and are not well soluble in solvents.

Still another type of synthetic resin has been described in Douglas et al. U.S. Pat. No. 3,932,332. This patent discloses the manufacture of copolymers of $\alpha$-methylstyrene and styrene in which the $\alpha$-methylstyrene is present in amounts of 50 to 90% and the softening point ranges from about 60° to 100° C. This starting material may be commercially available but would have to be further purified at the expense of additional cost.

SUMMARY OF THE INVENTION

The present invention provides improved pressure-sensitive adhesive compositions which contain synthetic or natural rubbers in combination with aromatic hydrocarbon resins which are less costly, more abundantly available and comparable to or even exceeding the quality of terpene resins.

In accordance with the present invention, there is provided a pressure-sensitive adhesive composition which contains at least 50% by weight of styrene-butadiene copolymers in combination with a resin component consisting of an aromatic hydrocarbon resin resulting from the polymerization of a thermally cracked petroleum fraction at temperatures in the range of −30° to +60° C. in the presence of a Friedel-Crafts catalyst added in amounts of from 0.01 to 5 weight percent of the fraction. The fraction as originally recovered from petroleum refining has a boiling range of 140° to 220° C. and is further fractionated to separate indenes therefrom by fractionation at about 180° C. The final reactive fraction has a conjugated diolefin content of 0.7 weight percent or less, a ratio of conjugated diolefin content to total polymerizables of 3 percent or less, a total content of indene and its alkyl derivatives of 2 weight percent or less, and a ratio of indene content to total polymerizables of 8 percent or less.

DESCRIPTION OF THE PREFERRED EMBODIMENTS

The term "rubber component" as used herein includes styrene-butadiene copolymer rubbers commonly known as SBR and rubber mixtures consisting chiefly of SBR. Illustrative of these rubber components are cold rubber type SBR or hot rubber type SBR prepared by an emulsion polymerization process, and random copolymer type or block rubber type SBR prepared by a solution polymerization process. These SBRs may be mixed with other types of rubber such, for example, as natural rubber, isoprene rubber, butyl rubber, polyisobutylene, butadiene rubber, ethylene-propylene rubber, ethylene-propylene diene rubber, chloroprene rubber, nitrile rubber, or the like. Preferred among these rubbers are natural rubber and isoprene rubber. They may be used in amounts of 0 to 100 parts by weight, preferably 0 to 80 parts by weight, and most preferably 0 to 60 parts by weight for 100 parts by weight of SBR.

The term "resin component" includes aromatic hydrocarbon resins resulting from the polymerization of a thermally cracked petroleum fraction having a boiling range of from 140° to 220° C. which has been further fractionated to separate out indenes and higher boiling components.

Generally, petroleum hydrocarbon resins are prepared by polymerizing thermally cracked, normally liquid petroleum oil fractions having boiling ranges of 20° to 280° C., of 20° to 170° C., and 140° to 280° C. When a petroleum fraction boiling in the range of 20° to 140° C. is used for polymerization, the resulting resin will be substantially non-aromatic. Such fractions contain large amounts of conjugated diolefins and non-conjugated diolefins, so that the resin has a higher degree of unsaturation and very low weather resistance. When petroleum fractions boiling in the range of 140° to 280° C. are used, the resulting resin will be aromatic but is still not entirely satisfactory in its resistance to weather.

An investigation of the characteristic properties of each of the components in the starting petroleum fractions has indicated that it is possible to obtain a highly satisfactory tack-imparting resin by precise separation of certain selected components in the starting material.

The resin component of the pressure-sensitive adhesive composition according to the present invention is an aromatic hydro-carbon resin prepared from a starting petroleum fraction containing unsaturated components which are substantially styrene and its derivatives, and vinyl toluenes. This starting material is controlled by distillation and fractionation such that the content of conjugated diolefins is 0.7 weight percent or less and the ratio of conjugated diolefins to total polymerizables is 3% or less. The total content of indene and its alkyl derivatives is controlled to 2 weight percent or less, and the ratio of indene and alkyl derivatives to total polymerizables is controlled to 8% or less. The starting material is subjected to polymerization in the presence of a Friedel-Crafts catalyst. The catalyst is removed and thereafter unreacted petroleum fraction and low molecular weight polymers are removed by evaporation or distillation, whereby an aromatic hydrocarbon resin having the desired properties is obtained.

The starting material for the resin employed in accordance with the invention is a thermally cracked petroleum fraction which originally boils in the range from 140° to 220° C. and is produced in substantial amounts when ethylene, propylene, butenes and butadienes are produced by thermal cracking, for example, steam cracking of petroleum fractions such as naphtha, kerosene and light gas oil fractions.

A gas chromatographical analysis was made of the petroleum fraction boiling in the range of 140° to 220° C., with the results being tabulated below.

TABLE I

COMPONENTS IN CRACKED OIL OF 140°-220° C. FRACTION

| Component | Boiling point ° C. (760 mm. Hg abs) | Content (wt. percent) |
|---|---|---|
| Styrene | 145.8 | 13-20 |
| Allylbenzene | 156-157 | 0.1-1 |
| α-Methylstyrene | 165.4 | 0.5-6 |
| β-Methylstyrene | 175 | 0.5-6 |
| p-Vinyltoluene | 168 | 10-20 |
| m-Vinyltoluene | 169 | |
| o-Vinyltoluene | 171 | |
| Indene | 182.2 | 2-11 |
| Methylindene homologs | 184-206 | 1-3 |
| Dimethylindene and ethylindene homologs | 212 | |
| Xylene (o-, m-, and p-isomers | 138-142 | 17-10 |
| Ethylbenzene | 136.2 | |
| Isopropylbenzene | 152.5 | |
| Ethyltoluene (o-, m-, and p-isomers)- | 158-164.6 | 18-7 |
| n-Propylbenzene | 159.6 | 1-0.1 |
| Trimethylbenzene (1,3,5-, 1,2,4-, and 1,2,3-isomers) | 164.6-176.5 | 25-6 |
| Indane | 177 | 9-1 |
| Methylindane homologs | 182-203 | 2-0.5 |
| Dimethyl and ethylindane homologs | 4200 | |
| Naphthalene | 218 | |
| Dicyclopentadiene (1) | 170 | 0.2-3 |
| Undetected component (2) | 140-220 | 0.7-5.4 |

Note (1) A part or whole of the dicyclopentadiene may in some cases be depolymerized with heat into cyclopentadiene.

(2) A part of the undetected component contains cyclopentadiene-methylcyclopentadiene codimer and methylcyclopentadiene dimer. A part or whole thereof may in some cases be depolymerized with heat into cyclopentadiene and methylcyclopentadiene. It is possible to analyze these monomers by gas chromotography.

Where cyclopentadiene and methylcyclopentadiene are produced by heating and are contained in the starting oil as described in Notes (1) and (2) of Table I, these monomers are also considered as polymerizable components.

In order to produce a hydrocarbon resin suitable for the purpose of the invention, it is essential that a thermally cracked petroleum oil fraction boiling in the range of 140° to 220° C. be precisely distilled to obtain a particular fraction which satisfies the following conditions. The former fraction is conveniently referred to as "starting cracked oil," and the latter fraction as "starting fraction."

STARTING FRACTION (a) The total content of cyclopentadiene and methylcyclopentadiene; that is, the content of conjugated diolefin in the starting fraction separated from the starting cracked oil is adjusted to a value of 0.7 wt. percent or less and the rate of content of the conjugated diolefin defined in the following equation (1) is adjusted to 3% or less.

Rate of conjugated diolefin content (%)

$$= \frac{\text{Conjugated diolefin content in the starting fraction (wt. \%)}}{\text{Polymerizable component in the starting fraction (wt. \%)}} \times 100 \quad (1)$$

(b) The total content of indene and its alkyl derivatives in the starting fraction is adjusted to a value of 2 wt. percent or less and the rate of content of the indene defined in the following equation (2) is adjusted to 8% or less.

Rate of indene content (%)

$$\frac{\text{Content of indene and its alkyl derivatives in the starting fraction (wt. \%)}}{\text{Polymerizable component in the starting fraction (wt. \%)}} \times 100 \quad (2)$$

Each component of the starting cracked oil and of the starting fraction is analyzed by gas chromatography under the following conditions.

(i) Styrene, allylbenzene, 1,3,5-trimethylbenzene, and O-ethyltoluene are analyzed at 100° C. with a flow rate of helium at 60 cc/min by employing a column 3 meters long filled with "Celite" (manufactured by Johns-Manville Corp.) containing 20% by weight of "Apiezon L grease" (manufactured by Associated Electrical Industries Ltd.).

(ii) Other components than those listed in (i) are analyzed at 125° C. with helium flowing at a rate of 60 cc/min by employing a similar column filled with "Celite" containing 20% by weight of polyethylene glycol 4,000.

The total content of styrene, its alkyl derivatives, indene, its alkyl derivatives, cyclopentadiene, methylcyclopentadiene analyzed as above is considered as a polymerizable component.

For the separation of the starting fraction from the starting cracked oil, there may be employed any convenient and suitable process such as for example atmospheric distillation, vacuum distillation and extractive distillation.

As previously stated, it is one of the requisite conditions in the preparation of the starting polymerization fraction from the starting cracked oil that the total content of cyclopentadiene and methylcyclopentadiene, namely, the content of conjugated diolefin should be held at a value of 0.7 weight percent or less and the ratio of conjugated diolefins at 3 percent or less. This condition may be conveniently met with by distilling either the starting cracked oil or the fraction which contains the required total content of indene and alkyl indene and the required ratio of indene content, thereby selectively removing conjugated diolefins. This operation is facilitated by the fact that the boiling points of cyclopentadiene and methylcyclopentadiene are 42° and 70° C., respectively, which are lower than the initial boiling point of the starting cracked oil.

If these conjugated diolefins are in the form of Diels-Alder dimers as found in the starting cracked oil, there may be conveniently employed an atmospheric distillation to obtain the adjusted values of total indene content and ratio of indene content, in which distillation the conjugated diolefin dimers can be depolymerized into conjugated diolefins which may be thereafter removed from the starting fraction by distillation.

However, if such conjugated diolefin dimers are found only in a minor proportion in the starting fraction, it is not always necessary to remove them because the dimers as compared to conjugated diolefins are less harmful to the resulting resin with respect to its resistance to weather and heat.

In order to satisfy the second requisite condition that the total content of indene and alkyl indene is 2 weight percent or less and the ratio of indene content is 8 percent or less, the starting cracked oil may be conveniently distilled to remove conjugated diolefins, with the distillate further subjected to precise fractionation. Since o-vinyltoluene and indene normally boil at 171° C. and 182.2° C., respectively, this boiling difference may be utilized so that the starting fraction satisfying the requirements of the resin of the invention can be taken overhead from the column.

In the art of petroleum resins it is an entirely new concept to take a selected component in a thermally cracked petroleum oil and subject it to a precise fractionation to obtain a fraction having highly restricted characteristics. Particularly, as disclosed herein, this concept is directed to restricting the content and ratio of content of conjugated diolefins and indenes to certain values as above listed. This operation can not be performed by ordinary known distillation columns but it requires an atmospheric or vacuum fractionator equipped with a greater number of trays.

To the starting fraction prepared as above is added 0.01–5 weight percent of a Friedel-Crafts type catalyst such a boron trifluoride, aluminum chloride, and complex compound of boron trifluoride and phenol, preferably, boron trifluoride, boron trifluoride etherate, and boron trifluoride phenolate. The resulting mixture is polymerized at a temperature ranging between −30+ and +60° C. for a period of 10 minutes to 15 hours. Then, the catalyst is decomposed and removed with alkalies such as caustic soda and sodium carbonate. If necessary, the thus treated reaction product is washed with water, and unreacted oil and low molecular weight polymers are separated from the reaction product by evaporation or distillation. The resulting product is an aromatic hydrocarbon resin having a softening point of 60°–120° C. and a bromine value of 15 or less. It has excellent resistance to weather and heat. The preferred resin has a softening point of 80°–100° C.

It has now been found that if any of the four important criteria for the starting fraction, namely, i) 0.7 wt. % conjugated diolefin content, ii) 3% conjugated diolefin content ratio, iii) 2 wt. % indene and its alkyl derivative content, and iv) 8% indene content ratio, should be neglected, the hydrocarbon resin resulting from the polymerization of such defective starting fraction will exhibit very poor resistance to weather and heat, will become yellowish and when used in a pressure-sensitive adhesive composition, will be unsatisfactory in respect of the weather-resistance, cohesive strength, adhesive strength, tackiness and tackiness lift.

The pressure-sensitive adhesive compositions according to the invention are prepared by blending the above-specified aromatic hydrocarbon resin with styrene-butadiene rubber (SBR) or rubbery mixtures chiefly consisting of SBR. Blending ratios may vary widely. Generally, the resin may be 20 to 140 parts by weight, preferably 30 to 120 parts by weight per 100 parts rubber. If desired, there may be added various additives including for example about 0 to 60 parts of a softening agent, 0 to 60 parts of a plasticizer, 0 to 100 parts of a filler and 0 to 50 parts of an aging inhibitor. These parts may depend upon the type of rubber component used but may usually be in the range of 0 to 100 parts per 100 parts rubber.

The invention will be further described with reference to the following examples presented only for purposes of illustration but not in a limiting sense.

EXAMPLE 1

The resin component for use in the pressure-sensitive adhesive compositions of the invention is prepared in the manner following.

The starting cracked oil previously defined was a by-product of the steam cracking of naphtha and had a boiling point in the range of 140° C. to 220° C. It was analyzed by gas chromatography to reveal the following composition:

| | |
|---|---|
| Polymerizable components (wt. %) | 49.0 |
| Total content of cyclopentadiene and methyl cyclopentadiene (wt. %) | 1.6 |
| Total content of indene and its alkyl derivatives (wt. %) | 8.4 |
| Content of dicyclopentadiene (wt. %) | 0.4 |
| Ratio of conjugated diolefin content (%) | 4.0 |
| Ratio of indene content (%) | 18.5 |

The above-identified starting cracked oil was charged via a heater into a first fractionator A-1 and thence to a second fractionator B-1, both fractionators being as specified in the following table.

TABLE II

SPECIFICATIONS AND OPERATING CONDITIONS OF FRACTIONATORS

| Fractionators | A-1 | B-1 |
|---|---|---|
| Type of tray | (1) | (2) |
| Number of trays | 30 | 7 |
| Feed tray (from the bottom) | 18 | 4 |
| Feed temperature (° C.) | 108 | 55 |
| Bottom pressure (mm. Hg. abs.) | 120 | 110 |
| Bottom temperature (° C.) | 145 | 120 |
| Top temperature (° C.) | 93 | 25 |
| Top pressure (mm. Hg. abs.) | 68 | 95 |
| Residence time at bottom (hr.) | 1.0 | 0.5 |

TABLE II-continued

| SPECIFICATIONS AND OPERATING CONDITIONS OF FRACTIONATORS | | |
|---|---|---|
| Fractionators | A-1 | B-1 |
| Reflux ratio | 5.0 | 2.0 |

(1) Sieve
(2) Bubble cap

The operating conditions of the fractionator A-1 had been chosen so that the overhead fraction of this fractionator contained a total content of indene and its alkyl derivatives of 2 weight percent of less and a ratio of indene content of 8 percent or less. The overhead product of the first fractionator A-1 was thereafter introduced into the second fractionator B-1 which was operated also under the above tabulated conditions so that there was obtained a desired starting fraction from the bottom of the fractionator B-1 in which the total content of cyclopentadiene and methyl cyclopentadiene was 0.7 weight percent or less and the ratio of diolefin content was 3 percent or less. Conjugated diolefins were removed from the top of the fractionator B-1. This operation produced 58 parts of the starting fraction from 100 parts of the starting cracked oil. The resulting starting fraction consisted of the following composition:

Composition of Starting Fraction

| | |
|---|---|
| Polymerizable components (wt. %) | 42.60 |
| Total content of cyclopentadiene and methyl cyclopentadiene (wt. %) | 0.40 |
| Total content of indene and its alkyl derivatives (wt. %) | 1.00 |
| Ratio of conjugated diolefin content (%) | 0.84 |
| Ratio of indene content (%) | 2.51 |

To the starting fraction thus obtained was added 0.5 weight percent of boron trifluoride phenol complex as catalyst, and polymerization was carried out for 3 hours at 20° C. The product was washed with an aqueous solution of sodium hydroxide to remove the catalyst and then washed with water. Unreacted oil and low polymers were removed from the product by distillation. The resulting resin had a softening point by the Ring and Ball method of 95° C., a bromine value of 7 (according to ASTM D-1158-57T) and a Gardner color $1^-$ (according to ASTM D-1544-58T). The resin was blended in amounts of 30 parts, 50 parts, 80 parts and 100 parts by weight, respectively, per 100 parts by weight of a commercially available styrene-butadiene rubber (SBR). The blend was dissolved in toluene to make up 20 weight percent concentration.

EXAMPLE 2

50 parts by weight of the resin prepared in Example 1 were blended with 70 parts by weight of SBR and 30 parts by weight of natural rubber, and the whole was dissolved in 600 parts by weight of toluene.

Comparative Examples 1 and 2

The starting cracked oil was subjected to polymerization under the same conditions as in Example 1. A similar operation was also carried out with the starting cracked oil but at a polymerization temperature of 60° C. There were obtained two different resins, one having a softening point of 120° C., a bromine value of 12 and a color of 2, and the other having a softening point of 80° C., a bromine value of 25 and a color of 5. These resins were blended each in amounts of 30, 50, 80 and 100 parts by weight per 100 parts by weight of SBR.

Comparative Examples 3 and 4

The procedure of Comparative Example 1 was followed except that the following resins were used.

Comparative Example 3: Picolite A (softening point 115° C.), a terpene resin, manufactured by Esso Chemicals Co.

Comparative Example 4: YS resin PX1150 (softening point 115° C.), a terpene resin, manufactured by Yasuhara Resin Industries Ltd.

Comparative Examples 5–8

The procedure of Example 2 was followed except that 50 parts by weight of each of the resins used in Comparative Examples 1–4 was blended with the rubber components.

The various pressure-sensitive adhesive compositions obtained in the foregoing Examples and Comparative Examples were subjected to the following tests and the results of these tests are shown in Tables III and IV.

1. Test of Tackiness:

Each of the various adhesives obtained as above was applied to a polyester film (38 microns thick) to a thickness of about 30 microns. The coated film was disposed for 25 hours at room temperature of 23° ± 1° C. thereby making an adhesive tape. This tape was tested for its tackiness by the J. Dow Ball Rolling Method in which steel balls measuring in the range of 32/32 inch to 1/32 inch diameter were rolled on the adhesive tape tilted at an angle of 30° with an approach run of 10 cm. The largest diameter ball that stopped within an adhesive area of 10 cm. square of the tape was taken as a measure of tackiness of each particular adhesive composition. The larger the ball number, the greater the tack, as shown in Tables III and IV.

2. Test of Adhesive Strength:

This was conducted in accordance with the provisions of Japanese Industrial Standards (JIS) Z-1523. The adhesive tapes prepared as above were cut to 25 mm wide strips and stuck on a stainless steel panel polished by a water-proof polishing paper. The force was measured which was required to peel the strips 180° at a rate of 300 mm per minute.

3. Test of Cohesive Strength:

This test was in accordance with JIS Z-1524 in which strips of the adhesive tapes measuring 25 cm by 25 cm were attached to a stainless steel panel fixed in position. The distance was measured by which the test strip was shifted under the influence of a 1 kg load applied to the film parts of the tape after a lapse of 24 hours.

The test strips that had been subjected to Test 1 above were further disposed at room temperature of 23° ± 1° C. for a period of 7 consecutive days and thereafter again tested by the procedure of Test 1.

5. Test of Weather-Resistance:

Each test adhesive was coated on a cellophane paper to a thickness of 30 microns and disposed at room temperature of 23° ± 1° C. for 24 hours. To the thus prepared adhesive cellophane was stuck a white paper which was then radiated by a 15 W. sterilization lamp located 30 cm apart. Changes of color of the adhesive compositions over a period of 15 hours were observed with the naked eye. This color evaluation was indicated in Table III by the following marks:

++ Excellent (substantially colorless transparent)
+ Good (slightly yellowish)

X Bad (extremely yellowish)

It has thus now been found that the pressure-sensitive adhesive compositions provided in accordance with the present invention exhibit an excellent balance of adhesive strength, cohesive strength, tackiness and weather resistance as compared to those prepared in Comparative Examples.

TABLE III:

| Adhesive Compound | Resin (wt. parts) | Tackiness (Ball NO.) | TEST RESULTS Adhesive Strength (g/25 mm wide) | strength (distance of tape shift)(mm) | Tack Life (Ball NO.) | Weather Resistance |
|---|---|---|---|---|---|---|
| Example 1 | 30 | 18 | 1,900 | 0.5 | 7 | ++ |
| | 50 | 15 | 2,000 | 0.5 | 7 | ++ |
| | 80 | 10 | 2,050 | 1.0 | 4 | ++ |
| | 100 | 6 | 2,200 | 1.0 | 0 | ++ |
| Comparative Example 1 | 30 | 5 | 800 | 0.5 | 0 | X |
| | 50 | 3 | 900 | 0.5 | 0 | X |
| | 80 | 0 | 950 | 1.0 | 0 | X |
| | 100 | 0 | 0 | * | 0 | * |
| Comparative Example 2 | 30 | 5 | 900 | 0.5 | 0 | X |
| | 50 | 4 | 950 | 0.5 | 0 | X |
| | 80 | 2 | 1,100 | 1.0 | 0 | X |
| | 100 | 0 | 1,150 | 1.0 | 0 | X |
| Comparative Example 3 | 30 | 14 | 1,550 | 1.0 | 5 | ++ |
| | 50 | 10 | 1,600 | 1.0 | 5 | ++ |
| | 80 | 5 | 1,850 | 1.5 | 0 | ++ |
| | 100 | 0 | 2,150 | 2.0 | 0 | + |
| Comparative Example 4 | 30 | 0 | 0 | * | 0 | * |
| | 50 | 0 | 0 | * | 0 | * |
| | 80 | 0 | 0 | * | 0 | * |
| | 100 | 0 | 0 | * | 0 | * |

Note:
The mark * indicates that the adhesive strength was too low to determine the respective properties.

TABLE IV:

| Adhesive Compound | TEST RESULTS Tackiness (Ball No.) | Adhesive strength (g/25 mm wide) | Cohesive strength (distance of tape shift) (mm) |
|---|---|---|---|
| Example 2 | 13 | 1,400 | 0.0 |
| Comparative Example 5 | 0 | 1,150 | 0.0 |
| Comparative Example 6 | 5 | 1,100 | 0.5 |
| Comparative Example 7 | 19 | 1,050 | 1.0 |
| Comparative Example 8 | 7 | 1,250 | 1.0 |

We claim as our invention:

1. A pressure-sensitive adhesive composition which comprises a rubber component including at least 50% by weight of styrene-butadiene copolymers in combination with a resin component consisting of an aromatic hydrocarbon resin resulting fron the polymerization of a reactive thermally cracked petroleum fraction at temperatures in the range of −30° to +60° C. in the presence of a Friedel-Crafts catalyst, said fraction boiling in the range of 140° to 180° C. and resulting from the fractionation of an original cracked oil fraction having a boiling range of 140° to 220° C., said original fraction containing from 10 to 17% mono- and di-alkylbenzenes and from 6 to 25% trialkylbenzenes, said reactive fraction having a conjugated diolefin content of 0.7 weight percent or less, a ratio of conjugated diolefin content to total polymerizables of 3% or less, a total content of indene and its alkyl derivatives of 2 weight percent or less, and a ratio of indene content to total polymerizables of 8% or less.

2. A pressure-sensitive adhesive composition according to claim 1 wherein said original fraction contains about 10 to 20% of vinyl toluenes boiling from 168° to 171° C.

3. The composition of claim 1 wherein said resin component has a softening point in the range of 60° to 120° C. and a bromine value of 15 or less.

4. The composition of claim 1 in which said resin component is blended in amounts of from 20 to 140 parts per weight per 100 parts by weight of said rubber component.

* * * * *